US007160390B2

(12) United States Patent
Tsuda et al.

(10) Patent No.: US 7,160,390 B2
(45) Date of Patent: Jan. 9, 2007

(54) DIE HEAD COATING, COATING DEVICE, AND METHOD OF MANUFACTURING DIE HEAD FOR COATING

(75) Inventors: Takeaki Tsuda, Tokyo-To (JP); Hiroshi Yoshiba, Tokyo-To (JP); Takashi Aoki, Tokyo-To (JP)

(73) Assignee: Dai Nippon Printing Co. Ltd, Tokyo (JP)

( * ) Notice: Subject to any disclaimer, the term of this patent is extended or adjusted under 35 U.S.C. 154(b) by 55 days.

(21) Appl. No.: 10/494,893

(22) PCT Filed: Jul. 18, 2003

(86) PCT No.: PCT/JP03/09204

§ 371 (c)(1),
(2), (4) Date: May 7, 2004

(87) PCT Pub. No.: WO2004/009248

PCT Pub. Date: Jan. 29, 2004

(65) Prior Publication Data

US 2005/0000420 A1 Jan. 6, 2005

(30) Foreign Application Priority Data

Jul. 18, 2002 (JP) ..... 2002-210207
May 30, 2003 (JP) ..... 2003-153599

(51) Int. Cl.
*B05C 3/02* (2006.01)

(52) U.S. Cl. ..... 118/410; 118/419

(58) Field of Classification Search ..... 118/410, 118/419; 427/356; 425/461; 451/28
See application file for complete search history.

(56) References Cited

U.S. PATENT DOCUMENTS 5,100,739 A * 3/1992 Kuruma et al. ..... 428/614
5,624,497 A * 4/1997 Tanaka et al. ..... 118/410
6,139,639 A * 10/2000 Kitamura et al. ..... 118/680
6,652,653 B1 * 11/2003 Kokubo et al. ..... 118/410

FOREIGN PATENT DOCUMENTS

JP 9-253555 A 9/1997
JP 2001-46328 A 2/2001
JP 2001-276709 A 10/2001
JP 2002-36110 A 2/2002

OTHER PUBLICATIONS

International Search Report for PCT/JP03/09204 mailed on Sep. 24, 2003; ISA/JPO.

* cited by examiner

*Primary Examiner*—Brenda A. Lamb
(74) *Attorney, Agent, or Firm*—Harness, Dickey & Pierce, P.L.C.

(57) ABSTRACT

During displacement relative to a substrate 1, a coating die head emits coating liquid out of a slot 12*a* to a surface of the substrate. The coating die head includes a lip 12*b* having a lip surface 12*b* and a side having a side surface 12*c*. A contact angle of the surface 12*c* with respect to the coating liquid is greater than a contact angle of the surface 12*b* with respect to the coating liquid. This configuration enhances stabilization of bead of the coating liquid during application process of the coating liquid, preventing stripes and steps from appearing in the coating layer. This coating die head makes it possible to carry out high precision coating required for fabrication of color filters for liquid crystal displays.

11 Claims, 10 Drawing Sheets

DIE HEAD COATING, COATING DEVICE, AND METHOD OF MANUFACTURING DIE HEAD FOR COATING

FIELD OF THE INVENTION

The present invention relates to a coating die head, a coating apparatus, and a method for fabricating a coating die head.

BACKGROUND ART

Commonly, the fabrication of color filters for liquid crystal displays involves the coating of resist liquid onto a substrate, which includes a sheet of glass, in order to provide triple-layers of red (R), green (G) and blue (B) or to provide a protective surface layer or geometric shapes. For high precision coating required for the fabrication, spin coating has been used. In spin coating, an excessive amount of resist material, which is costly, is applied onto the surface of a substrate, and the substrate is rotated at a high speed. The spin coating poses the problem that the radial velocity of the rotating substrate causes a substantial portion of the resist material to be scattered away from the substrate surface, thereby wasting a large amount of the applied resist material and causing high production costs.

This problem of spin coating makes it desirable to improve coating processes by using a coating die head such that the spin coating is no longer needed.

However, the known coating processes of this kind fail to accomplish desired thickness uniformity of a coating layer because they allow occurrence of stripes extending in a direction of the movement of a substrate and steps lying laterally with respect to the direction of the movement of the substrate.

SUMMARY OF THE INVENTION

In view of the problems with the prior art, the present invention has been devised. An object of the present invention is to provide a coating die head, a coating apparatus, and a method for fabricating the coating die head, which provide high precision coating required for fabrication of color filters for liquid crystal displays.

Extensive effort made by the inventors to stabilize beads of liquid during a die head coating process has enabled them to accomplish the present invention. Specifically, the inventors found that in making a contact angle of a side surface of a terminal segment of a die head with respect to the coating liquid greater than a contact angle of a lip surface of a lip on the terminal segment with respect to the coating liquid, a point can be maintained at which the uppermost portion of a bead of liquid falls off the coating die head always at an area where the lip surface and the side surface define therebetween a border line.

According to one exemplary implementation of the present invention, there is provided a coating die head with a slot for emitting coating liquid to be applied to a substrate, comprising: a lip located on a terminal segment of the coating die head and having a lip surface extending from the slot; and a side located on the terminal segment and having a side surface inclined to the lip surface, wherein the side surface and the lip surface are configured such that a contact angle of the side surface with respect to the coating liquid is greater than a contact angle of the lip surface with respect to the coating liquid.

According to another exemplary implementation of the present invention, the coating die head is provided, wherein the side surface and the lip surface are configured such that the contact angle of the side surface with respect to the coating liquid is greater than the contact angle of the lip surface with respect to the coating liquid by a difference, in angle, that is greater than or equal to 5 degrees.

According to another exemplary implementation of the present invention, the coating die head is provided, wherein surface material of the side surface is different from that of the lip surface.

According to another exemplary implementation of the present invention, the coating die head is provided, wherein surface roughness of the side surface is different from that of the lip surface.

According to another exemplary implementation of the present invention, the coating die head is provided, a border line is provided between the lip surface and the side surface and the border line has straightness and parallelness, with respect to the slot, which are less than or equal to 5 μm/m; wherein, around the border line, a contact angle border line is provided between the adjacent regions that differ from each other in contact angle with respect to the coating liquid; and wherein a deviation between the contact angle border line and the border line is less than or equal to 5 μm.

According to another implementation of the present invention, there is provided a coating apparatus comprising: a coating die head with a slot for emitting coating liquid to be applied to a substrate, the coating die head including a lip located on a terminal segment of the coating die head and having a lip surface extending from the slot; and a side located on the terminal segment and having a side surface inclined to the lip surface, wherein the side surface and the lip surface are configured such that a contact angle of the side surface with respect to the coating liquid is greater than a contact angle of the lip surface with respect to the coating liquid; and means for carrying out relative displacement between the substrate and the coating die head with the terminal segment held in close proximity to the substrate for application of the emitted coating liquid to the substrate.

The implementations of the present invention can stabilize bead during coating process, preventing occurrence of stripes and steps, which were apt to be formed in a coating layer applied using a coating die head. Accordingly, if it is used during a resist coating process of fabrication of color filters for liquid crystal displays, each of the implementations of the present invention can carry out high precision coating required for the fabrication, making it possible to carry out the coating process without spin coating, resulting in a cost reduction.

According to another implementation of the present invention, there is provided a coating die head with a slot for emitting coating liquid to be applied to a substrate, comprising: a lip located on a terminal segment of the coating die head and having a lip surface extending from the slot; and a side located on the terminal segment and having a side surface inclined thereto, wherein surface roughness of the lip surface expressed in terms of the maximum height, Rmax, measured in accordance with Japanese Industrial Standard JIS B 0601 is less than or equal to 0.3 μm.

According to another implementation of the present invention, the coating die head is provided, wherein the lip surface is of mirror finish resulting from super fine grinding.

According to another implementation of the present invention, the coating die head is provided, wherein the lip surface is of mirror finish resulting from electrolytic in-process dressing (ELID) grinding.

According to some of the implementations of the present invention, the lip surface has surface roughness smooth enough to sufficiently suppress local changes in contact angle, allowing smooth movement of coating liquid in such directions as to increase dimension of bead laterally with respect to a direction of displacement of a substrate relative to the coating die head during application of the coating liquid to the substrate, thus shortening time required for bead build-up. Accordingly, if it is used during a resist coating process of fabrication of color filters for liquid crystal displays, the coating die head can carry out high precision coating required for the fabrication by shortening as best as possible a fault range where desired thickness uniformity fails to be accomplished.

According to another implementation of the present invention, the coating die head is provided, wherein the side surface and the lip surface are configured such that a contact angle of the side surface with respect to the coating liquid is greater than a contact angle of the lip surface with respect to the coating liquid.

This configuration can hold a point, at which the uppermost portion of liquid of bead falls off the coating die head, always at an area where the lip surface and the side surface define therebetween a border line. Accordingly, if it is used during a resist coating process of fabrication of color filters for liquid crystal displays, the coating die head incorporating the above-mentioned configuration can carry out high precision coating required for the fabrication by suppressing thickness variation in a coating layer.

According to another implementation of the present invention, the coating die head is provided, wherein the side surface is made of electroless plating of a mixture containing nickel (Ni) and 1 to 10 wt % of fluororesin.

According to another implementation of the present invention, the coating die head is provided, wherein surface roughness of the side surface is different from that of the lip surface.

This implementation of the present invention can hold a point, at which the uppermost portion of liquid of bead falls off the coating die head, always at an area where the lip surface and the side surface define therebetween a border line. Accordingly, if it is used during a resist coating process of fabrication of color filters for liquid crystal displays, the coating die head incorporating this configuration can carry out high precision coating required for the fabrication by suppressing thickness variation in a coating layer.

According to another implementation of the present invention, the coating die head is provided, wherein a border line is provided between the lip surface and the side surface, and the border line has straightness and parallelness, with respect to the slot, which are less than or equal to 2 μm/m.

If it is used during a resist coating process of fabrication of color filters for liquid crystal displays, this implementation of a coating die head according to the present invention can carry out high precision coating required for the fabrication by shortening as best as possible a fault range where desired thickness uniformity fails to be accomplished during initial stage of application of the coating liquid to a substrate.

According to another implementation of the present invention, the coating die head is provided, wherein, around a border line between the lip surface and the side surface, a contact angle border line is provided between the adjacent regions that differ from each other in contact angle with respect to the coating liquid; and wherein a deviation between the contact angle border line and the border line is less than or equal to 2 μm.

If it is used during a resist coating process of fabrication of color filters for liquid crystal displays, this implementation of a coating die head according to the present invention can carry out high precision coating required for the fabrication by suppressing thickness variation in a coating layer.

According to another implementation of the present invention, there is provided a coating apparatus, comprising: a coating die head with a slot for emitting coating liquid to be applied to a substrate, the coating die head including a lip located on a terminal segment of the coating die head and having a lip surface extending from the slot; and a side located on the terminal segment and having a side surface inclined to the lip surface, wherein surface roughness of the lip surface expressed in terms of the maximum height, Rmax, measured in accordance with Japanese Industrial Standard JIS B 0601 is less than or equal to 0.3 μm; and means for carrying out relative displacement between the substrate and the coating die head with the terminal segment held in close proximity to the substrate for application of the emitted coating liquid to the substrate.

If it is used during a resist coating process of fabrication of color filters for liquid crystal displays, this implementation of a coating apparatus according to the present invention can carry out high precision coating required for the fabrication by shortening as best as possible a fault range where desired thickness uniformity fails to be accomplished during initial stage of application of the coating liquid to a substrate and by suppressing thickness variation in a coating layer.

According to another implementation of the present invention, there is provided a method for fabricating a coating die head with a slot for emitting coating liquid to be applied to a substrate, including a lip located on a terminal segment of the coating die head and having a lip surface extending from the slot; and a side located on the terminal segment and having a side surface inclined to the lip surface, wherein surface roughness of the lip surface expressed in terms of the maximum height, Rmax, measured in accordance with Japanese Industrial Standard JIS B 0601 is less than or equal to 0.3 μm, the method comprising the step of treating the lip surface to application of to mirror finish.

According to this implementation of a method according to the present invention, the lip surface has surface roughness smooth enough to sufficiently suppress local changes in contact angle, allowing smooth movement of coating liquid in such directions as to increase dimension of bead laterally with respect to a direction of displacement of a substrate relative to the coating die head during application of the coating liquid to a substrate, thus shortening time required for bead build-up. Accordingly, if it is used during a resist coating process of fabrication of color filters for liquid crystal displays, the implementation of a method according to the present invention can carry out high precision coating required for the fabrication by shortening as best as possible a fault range where desired thickness uniformity fails to be accomplished.

The coating die head and the coating apparatus according to the implementations of the present invention may find other applications than a resist coating of the fabrication of color filters for crystal displays.

Figure 1:
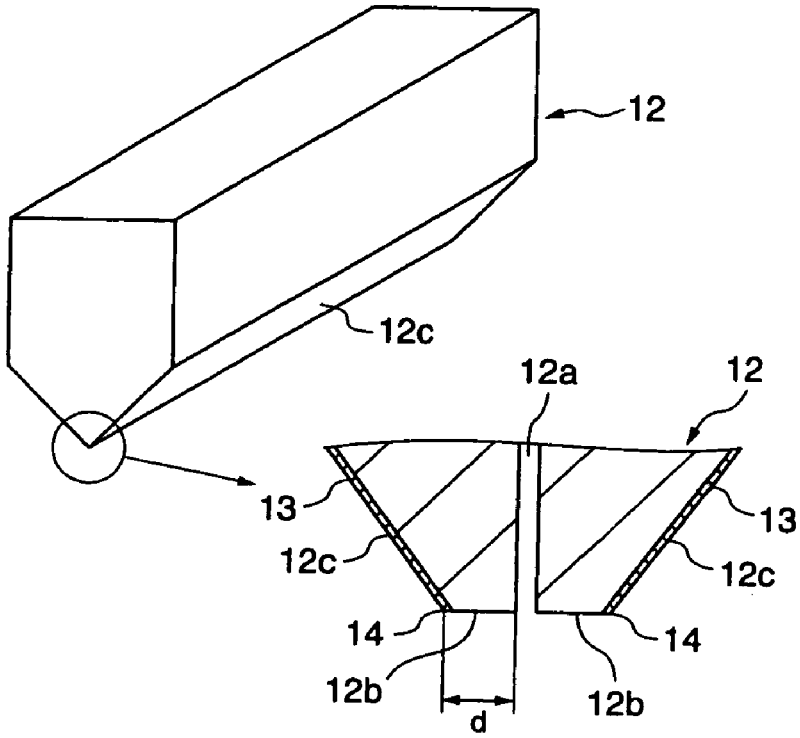
FIG. 1 is a perspective schematic view of one implementation of a coating die head according to the present invention together with an enlarged view of a portion of this perspective view.

BEST MODE FOR CARRYING OUT THE INVENTION ONE EMBODIMENT ACCORDING TO THE INVENTION

In one embodiment of a coating die head according to the present invention, a contact angle of a surface (namely, a side surface) of a side located on a terminal segment of the die head with respect to a coating liquid is greater than a contact angle of a surface (namely, a lip surface) of a lip located on the terminal segment with respect to the coating liquid.

This configuration enhances stabilization of a bead of liquid that is formed between the lip surface and a substrate during application of coating liquid to the substrate, allowing the coating die head to carry out high precision coating process at high speed. Preferably, the contact angle of the side surface with respect to the coating liquid is greater than the contact angle of the lip surface with respect to the coating liquid by an angle that is greater than or equal to 5 degrees. If this difference in contact angle is too small, the coating die head fails to satisfactorily stabilize the bead. The greater the difference in contact angle, the more the effectiveness on the stabilization. The stabilization of the bead creates a condition under which the coating die head can carry out more severe application processes for example, increasing the processing speed. Thus, it is preferrable to increase the difference in contact angle. Concretely, the difference in contact angle is preferably greater than or equal to 10 degrees. More preferably, the difference in contact angle is greater than or equal to 20 degrees.

There are various examples of accomplishing the above-mentioned configuration in which the contact angle of the side surface with respect to the coating liquid is greater than the contact angle of the lip surface with respect to the coating liquid. One example is making the side surface and/or the lip surface of plating or coating. Another example is making the side surface of material different from material of the lip surface by, for example, fabricating the lip and side as separate parts of different materials. Finishing the side surface to a surface roughness different from the surface roughness of the lip surface is still another example. Further, this configuration may be accomplished by any one of the combinations of the above-mentioned examples.

As the contact angle of the side surface with respect to the coating liquid is greater than the contact angle of the lip surface with respect to the coating liquid, this implementation of a coating die head of the present invention can maintain a point at which the uppermost portion of a bead of liquid falls off the die head always at an area where the lip surface and the side surface define a border line. The border line has straightness and parallelness with respect to the slot, which are important for suppressing thickness variation in a coating layer. Thus, when high precision coating process required for fabricating of color filters is needed, it is preferred that the deviations in the straightness and parallelness are as small as possible. Concretely, the deviations are less than or equal to 5 μm/m. Further, the microscopic area of a region about the border line shows that the side surface and/or the lip surface do not necessarily have the same contact angle over the whole area extending to the border line.

Even if a mask is used to cover the lip surface to expose, for example, the side of the terminal segment only during surface treatment to form, as the side surface, a coating layer that has a large contact angle with respect to the coating liquid, the edge of the coating layer does not always lie exactly on the border line, but it may extend beyond the border line or fail to reach it.

When a contact angle border line is provided or defined between the adjacent two regions that differ from each other in contact angle with respect to the coating liquid to such an extent as to demonstrate different identities in contact angle, it is least likely that the contact angle border line always lies exactly on the border line between the side surface and the lip surface. If a considerable deviation exits between the contact angle border line and the border line, the coating variation is likely to occur. To meet demand for high precision coating required for fabrication of color filters, the deviation is preferably less than or equal to 5 μm/m.

The implementation of a coating apparatus according to the present invention comprises means for carrying out relative displacement between the substrate and the coating die head with the terminal segment held in close proximity to the substrate for application of the emitted coating liquid to the substrate. Employing this construction makes it possible to carry out high precision coating on the substrate.

As they can carry out high precision coating, the embodiments of coating die head and coating apparatus according to the present invention can carry out coating of a resist liquid onto a substrate, which includes a sheet of glass, in order to provide triple-layers of red (R), green (G) and blue (B) or to provide a protective surface layer or geometric shapes during fabrication of color filters for liquid crystal displays, making it possible to carry out high precision coating required for the fabrication without using spin coating. The coating die head and the coating apparatus according to the embodiments of the present invention may have other applications than a resist coating for the fabrication of color filters for crystal displays.

Figure 2:
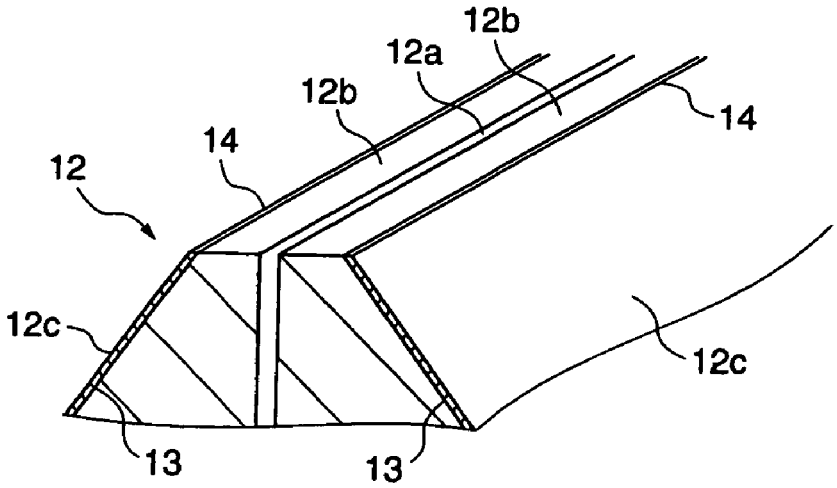
FIG. 2 is a perspective schematic view given by enlarging a terminal segment of the coating die head.

Referring to the drawings, preferred implementations of the present invention are described below. FIG. 1 is a perspective schematic view of one embodiment of a coating die head 12 according to the present invention together with an enlarged view of a portion of this perspective view. FIG. 2 is a perspective schematic view given by enlarging a terminal segment of the coating die head 12.

Similarly to the conventional one, the coating die head 12 has a slot 12*a* for emitting coating liquid to be applied, a lip 12*b* located on a terminal segment 12*c*, 12*b* of the coating die head 12 and having a lip surface 12*b* 12*b* extending outwardly from the slot 12*a* in a direction generally normal to the slot 12*a*, and a side 12*c* located on the terminal segment 12*b*, 12*c* having a side surface 12*c* extending outwardly from the surface of the lip 12*b* and inclined thereto. The whole body of this coating die head 12 is made of stainless steel. In this embodiment, the lip surface of the lip and the side surface of the side can be represented by reference numerals 12*b*, 12*c* respectively.

The lip surface 12*b* extends in the normal direction over a width d, which width d normally ranges from 0.1 to 1.0 mm. The lip surface 12*b* is a bare surface resulting from exposing a surface of the body of the coating die head 12 grounded to roughness falling in a range from 0.1 to 0.4 μm/m in Rmax. The side surface 12*c* consists of a surface layer 13 made of material having poor wettability with respect to the coating liquid, which surface layer has been deposited, by coating or plating, on the bare surface (base surface) of the body of the coating die head 12. The surface layer 13 of the side surface 12*c* has poor wettability with respect to the coating liquid (and thus a large contact angle with respect to the coating liquid).

Examples of surface treatment to provide the surface layer 13 are electroless plating of nickel (Ni), electroless plating of a mixture containing nickel (Ni) and fluororesin, and coating of fluororesin. Selection of material for the surface layer 13 can be made such that a contact angle of the side surface 12*c* with respect to the coating liquid is greater than a contact angle of the lip surface 12*b* with respect to the coating liquid. The selection can be made such that, for example, an angle, by which the contact angle of the side surface with respect to the coating liquid is greater than the contact angle of the lip surface with the coating liquid, is greater than or equal to 5 degrees. Preferably, this angle is greater than or equal to 10 degrees. More preferably, this angle is greater than or equal to 20 degrees.

If the coating liquid is in the form of liquefied resist generally used for the fabrication of color filters for liquid crystal displays, a contact angle of the lip surface 12*b* with respect to the coating liquid falls in a range from 7 degrees to 10 degrees. If, under this condition, the surface layer 13 is formed by electroless plating of nickel (Ni), a contact angle of the side surface 12*c* with respect to the coating liquid amounts to 20 degrees, and thus the difference in angle amounts to 10 degrees at least. If the surface layer 13 is formed of fluororesin coating, the contact angle of the side surface 12*c* with respect to the coating liquid amounts to 50 degrees, and thus the difference in angle amounts to 40 degrees at least. The coating of fluororesin is superior to the electroless plating of nickel (Ni) in providing an increased contact angle although the former is inferior to the latter in durability. Incorporating fluororesin into electroless nickel plating results in providing a contact angle greater than a contact angle provided by the electroless plating of nickel and also in providing enhanced durability as compared to the coating of fluororesin. Thus, the appropriate proportion of the mixture of nickel and fluororesin can be selected to meet a desired property to be applied the side surface 12*c*. The surface layer 13 can extend to cover at least a region, which might be covered by the spread of coating liquid during application of the coating liquid to the substrate.

As shown in FIG. 2, the surface layer 13 extends over the side surface 12*c* entirely to define an edge exactly lying on a border line between the lip surface 12*b* and the side surface 12*c*. The border line 14 provided between the lip surface 12*b* and the side surface 12*c* is straight, and it has straightness and parallelness, with respect to the slot 12*a*, which are less than or equal to 5 μm/m.

Figure 3:
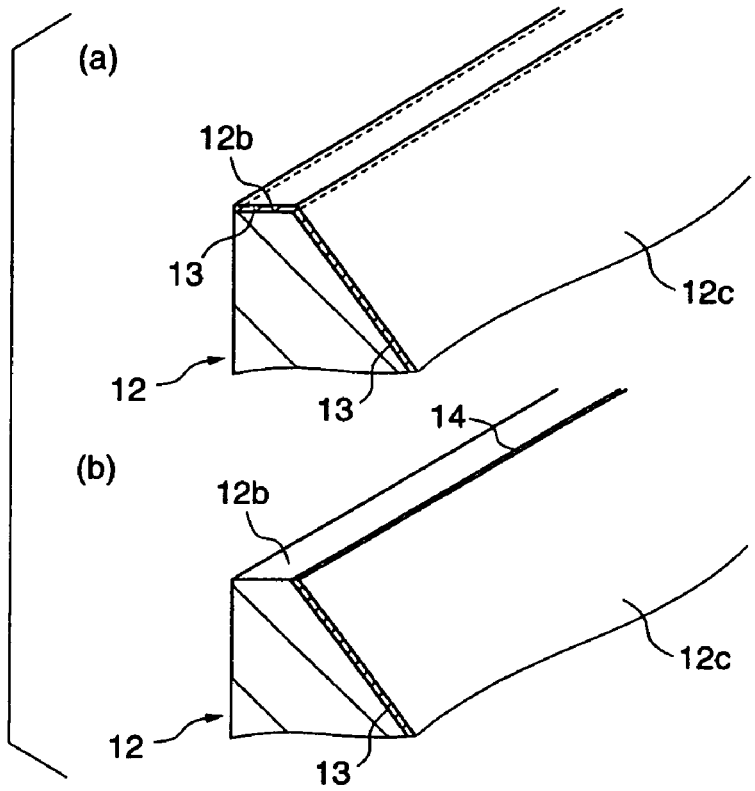
FIGS. 3(*a*) and 3(*b*) are perspective schematic views illustrating processes of fabricating the coating die head shown in FIG. 1.

In order to form the surface layer 13 to the edge exactly lying on the border line 14 having the straightness and parallelness less than or equal to 5 μm/m, the material of the surface layer 13 is deposited, by plating or coating, over the entire surface area of not only the side surface 12*c*, but also the lip surface 12*b* as shown in FIG. 3(*a*). Subsequently a portion of the material is removed, by polishing, to expose the surface of the lip 12*b* and the edge of the surface layer 13 as shown in FIG. 3(*b*).

Figure 4:
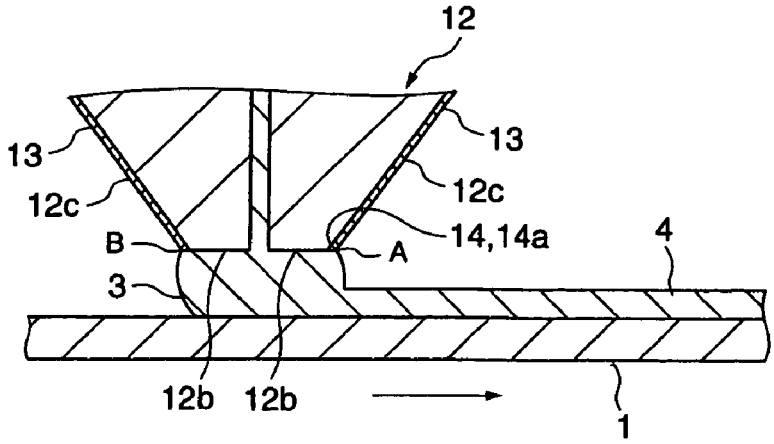
FIG. 4 is a cross sectional schematic view of the coating die head shown in FIG. 1 during application of coating liquid to the surface of a substrate.

For application of the coating liquid using the coating die head 12, the terminal segment 12*b*, 12*c* of the coating die head 12 is held in close proximity to the surface of a substrate 1 placed on a chuck (not illustrated) as shown in FIG. 4, and the substrate is moved relative to the coating die head 12. The coating die head 12 emits the coating liquid to be applied to the substrate 1, forming bead 3 between the lip surface 12*b* and the substrate 1, applying a portion separated from the bead 3 to the substrate 1.

As descried before, the contact angle of side surface 12*c* with respect to the coating liquid is greater than that of the lip surface 12*b*, which the bead 3 contacts with, causing the side surface 12*c* to demonstrate poor wettability as compared to the lip surface. This configuration can maintain a point A or B, at which the uppermost portion of the bead 3 of liquid falls off the coating die head 12, always at an area where the lip surface 12*b* with good wettability and the side surface 12*c* with poor wettability define therebetween the border line 14. During application of the coating liquid to the substrate 1, the bead 3 is kept stabilized, applying the coating liquid to the substrate 1 without allowing appearances of any stripes and steps conventionally experienced. Thus, a coating layer 4 can be formed so that the coating layer 4 has accomplished thickness uniformity by suppressing thickness variation to a sufficiently low level (for example, thickness variation within ±3% of the layer thickness). Accordingly, if it is used during a resist coating process of fabrication of color filters for liquid crystal displays, this coating die head 12 can carry out high precision coating (for example, thickness variation within ±3% of the layer thickness) required for the fabrication. The spin coating generally employed is no longer needed.

In the above-described implementation, the bare surface of the body makes the lip surface 12*b* and the surface layer 13 that has poor wettability makes the side surface 12*c*, providing the side surface with a contact angle greater than that of the lip surface. The present invention is not limited to this implementation and may be accomplished by covering the lip surface 12*b* with a surface layer that has wettability superior to that of the bare surface of the body, and making the side surface 12*c* by the bare surface of the body. Another approach to accomplish the present invention involves covering the lip surface 12*b* with one surface layer that has good wettability and covering the side surface 12*c* with another surface layer that has poor wettability.

Figure 5:
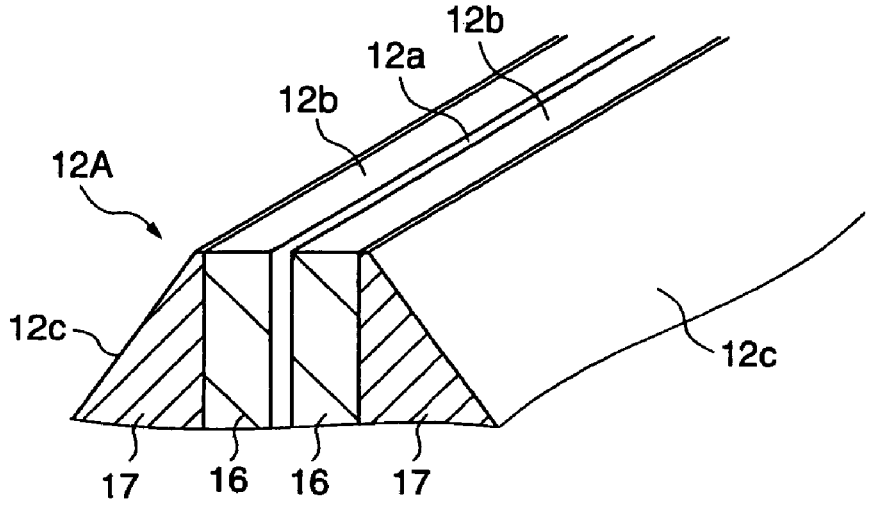
FIG. 5 is a perspective schematic view of a terminal segment of another implementation of a coating die head according to the present invention.
Figure 6:
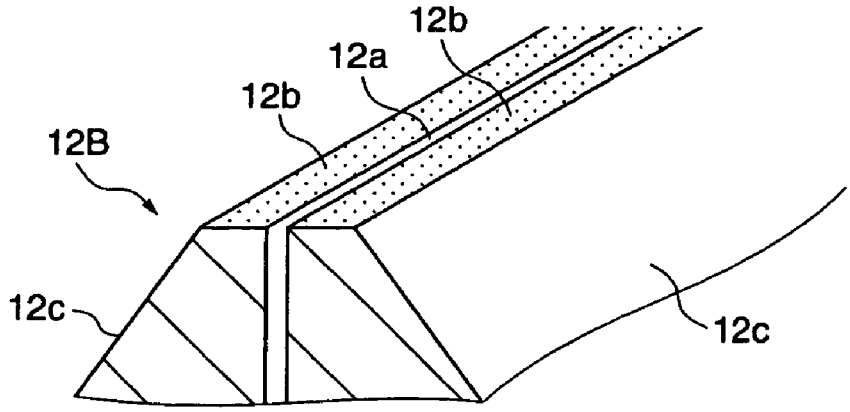
FIG. 6 is a perspective schematic view of a terminal segment of another implementation of a coating die head according to the present invention.

The surface treatment like plating or coating is just an example of altering contact angles of the lip surface 12*b* and the side surface 12*c*. The contact angles may be altered in any other appropriate manner. Referring to FIG. 5, a coating die head 12A includes separate members of different materials as portions 16 and 17, respectively, which make a lip surface 12*b* and a side surface 12*c*. Referring to FIG. 6, although it is made of the same material, a coating die head 12B is produced by a surface treatment to give a lip surface 12*b* more roughness to provide good wettability (reduced contact angle), and by another surface treatment to give a side surface 12*c* less roughness to provide poor wettability (increased contact angle). Using these measures, the contact angle of the side surface can be made greater than the contact angle of the lip surface. The contact angles of the lip surface and the side surface may be altered by appropriately combining a selection in material with a selection in surface treatment to provide roughness.

It is likely that, around the border line 14 between the lip surface 12*b* and the side surface 12*c*, a contact angle border line 14*a* exists, which is provided or defined between the adjacent two regions that differ from each other in contact angle with respect to the coating liquid to such an extent as to demonstrate different identities in contact angle. If this is the case, it is preferred that a deviation between the contact angle border line 14*a* and the border line 14 is less than or equal to 5 μm (see FIG. 4).

Figure 7:
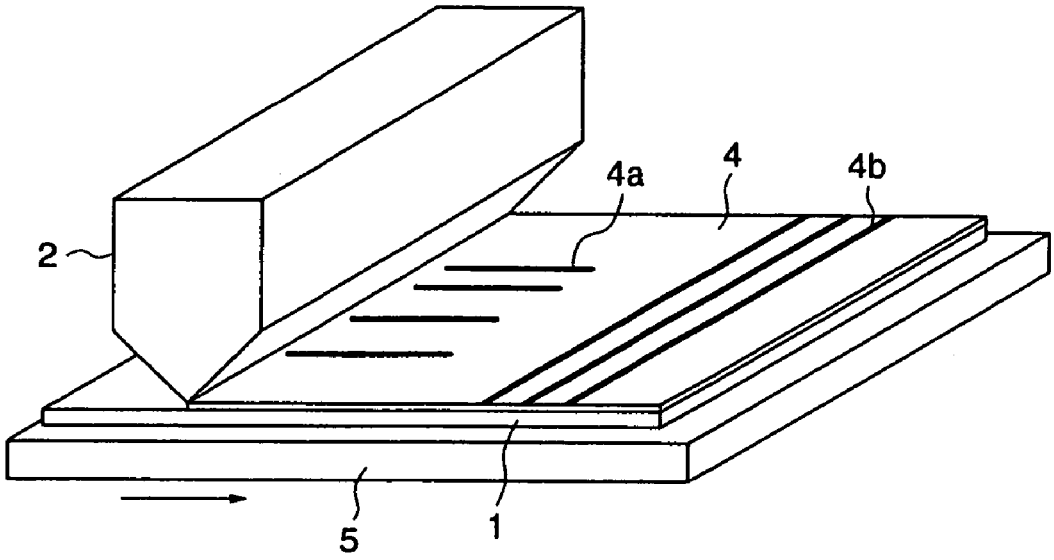
FIG. 7 is a perspective schematic view of one comparative example of a coating die head.
Figure 8:
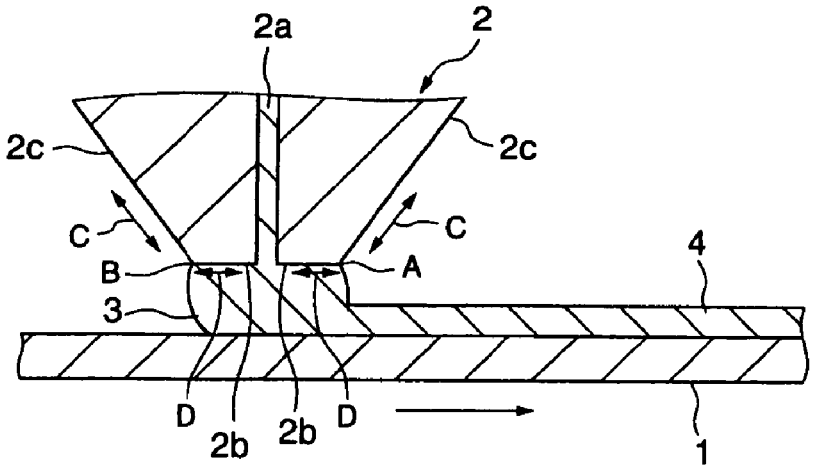
FIG. 8 is a cross sectional schematic view of the comparative example of the coating die head during application of coating liquid to the surface of a substrate.
Figure 9:
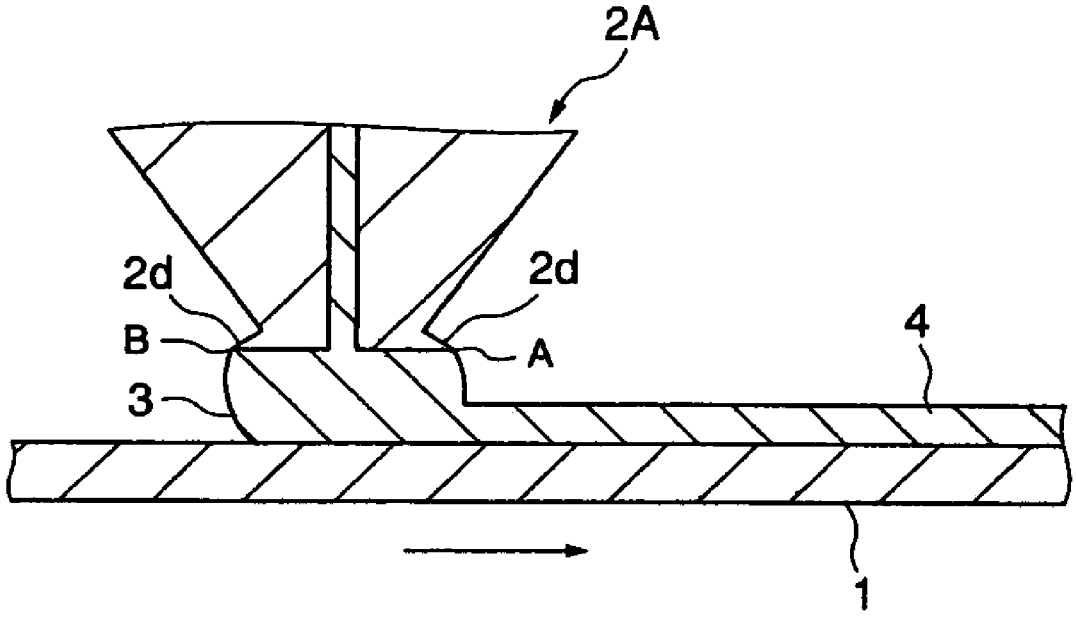
FIG. 9 is a cross sectional schematic view of another comparative example of a coating die head during application of coating liquid to the surface of a substrate.

With reference next to FIGS. 7 to 9, comparative examples to the present invention are described.

As shown in FIG. 7, a coating die head 2, which includes a generally-configured lip surface and a generally-configured side surface, is arranged with its terminal segment in close proximity to the surface of a substrate 1 placed on a chuck 5. Next, the chuck 5 moves the substrate 1 for displacement relative to the coating die head 2 emitting liquefied resist, applying the emitted liquefied resist to form a coating layer 4 on the surface of the substrate 1. Subsequently, thickness uniformity of the layer 4 is accomplished by rotating the substrate 1 at a high speed. The reason why the thickness uniformity cannot be accomplished without rotating the substrate 1 is that the application process with the coating die head 2 cannot suppress thickness variation within the acceptable range due to stripes 4*a* and steps 4*b* inevitably formed. This generally employed spin coating immediately after applying the resist to the substrate by the coating die head causes a cost increase because of two processes needed.

Next, description is made on what causes thickness variation in the coating layer when the coating die head 2 carries out application of coating liquid to the substrate. As shown in FIG. 8, the coating die head 2 has a slot 2*a* for emitting resist (coating liquid) to be applied, a lip 2*b* having a lip surface 2*b* extending outwardly from the slot 2*a* in a direction generally normal to the slot 2*a*, and a side 2*c* having a side surface 2*c* extending outwardly from the lip surface of the lip 2*b* and inclined thereto. During application of coating liquid to the surface of the substrate 1, the coating die head 2 forms coating liquid lump (bead) 3 between the lip surface 2*b* and the substrate 1. If this bead 3 were stabilized to maintain its shape thereby to hold a point A or B, at which the uppermost portion of the bead 3 of liquid falls off the coating die head 2, always at an area where the lip surface 2*b* and side surface 2*c* define therebetween a border line, the coating layer 4 would be free from the undesired thickness variation.

However, the comparative example cannot maintain the point A or B always at the area where the border line exists, allowing the liquid to flow around from the lip surface 2*b* to the side surface 2*c*, causing motion of the liquid along the side surface 2*c* as shown by arrows C as well as motion of the liquid along the lip surface 2*b* as shown by arrows D. Such motions of the liquid hamper stabilization of the bead 3, thus causing the point A or B from moving to various locations deviated from the border line. If the point A or B moves at each of a plurality of spaced points along the border line, stripes 4*a* (see FIG. 7) extending in a direction of movement of the substrate will appear, whereas if the point A or B moves to various locations continuously along the border line, steps 4*b* lying laterally with respect to the moving direction of the substrate 1 will appear.

In order to prevent the point A or B from moving to various locations for enhanced stabilization of bead 3, one may devise a coating die head 2A, as shown in FIG. 9, which has an acute edge 2*d* on or in parallel to a border line between a lip surface 2*b* and the adjacent side surface 2*c*. This coating die head 2A, however, still fails to sufficiently restrain the point A or B from moving to various locations, although it provides enhanced stabilization of the bead 3 more than the coating die head 2 shown in FIG. 7 does. In FIG. 9, a reduction, in number, of stripes and steps has been observed, but it is not appreciably large enough to provide high precision coating required during fabrication of color filters for crystal displays.

According to the present invention, the coating die head 12 can sufficiently enhance stabilization of the bead 3, thus preventing the stripes and steps from appearing in the coating layer 4.

EXAMPLE

Next, an embodiment according to the present invention is described.

(1) A coating die head: a coating die head 12

Material of a body of the coating die head 12: stainless steel

Lip surface 12*b*: Width: 500 μm;

Surface: the same material as the body (stainless steel);

Surface roughness Rmax: 0.4 μm;

Contact angle with respect to coating liquid: about 7 degrees:

Side surface 12*c*: Surface: Electroless plating of nickel;

Surface roughness Rmax: 0.4 μm;

Contact angle with respect to coating liquid: about 15 degrees:

Straightness of a border line between the lip surface 12*b* and the side surface 12*c*: less than or equal to 5 μm/m:

(2) Coating Liquid

Color resist on solvent systems;

Viscosity: 5 cP

Surface tension: 25 dyne/cm:

(3) Coating Condition

As shown in FIG. 4, with the coating die head 12 oriented downward, a substrate 1 was placed below the coating die head 12, and has been moved horizontally at a speed of 80 mm/second to apply the coating liquid to a depth of about 10 μm.

(4) Result

Visual inspection on a coating layer after application of the coating liquid to a substrate resulted in finding of no stripes and steps. After drying this coating layer, the coating layer measured 1.5 μm thick with thickness variation less than or equal to ±2%. The thickness variation of the coating layer fell in the acceptable range required for fabrication of color filters. Use of spin coating during fabrication of color filters was eliminated.

Because a contact angle of the side surface with respect to the coating liquid is greater than a contact angle of the lip surface with respect to the coating liquid, the coating die head according to the present invention can hold a point, at which the uppermost portion of liquid of bead falls off the coating die head, always at an area where the lip surface and the side surface define therebetween a border line, thereby to provide sufficiently stabilized bead. This configuration is effective enough to prevent stripes and steps from appearing in the coating layer and also to suppress thickness variation satisfactorily. If it is used during a resist coating process of fabrication of color filters for liquid crystal displays, this implementation according to the present invention can carry out high precision coating required for the fabrication. Thus, this implementation according to the present invention can accomplish cost reduction by eliminating spin coating.

ANOTHER EMBODIMENT ACCORDING TO THE INVENTION

Referring to the drawings, another embodiment of the present invention is hereinafter described in detail.

Figure 10:
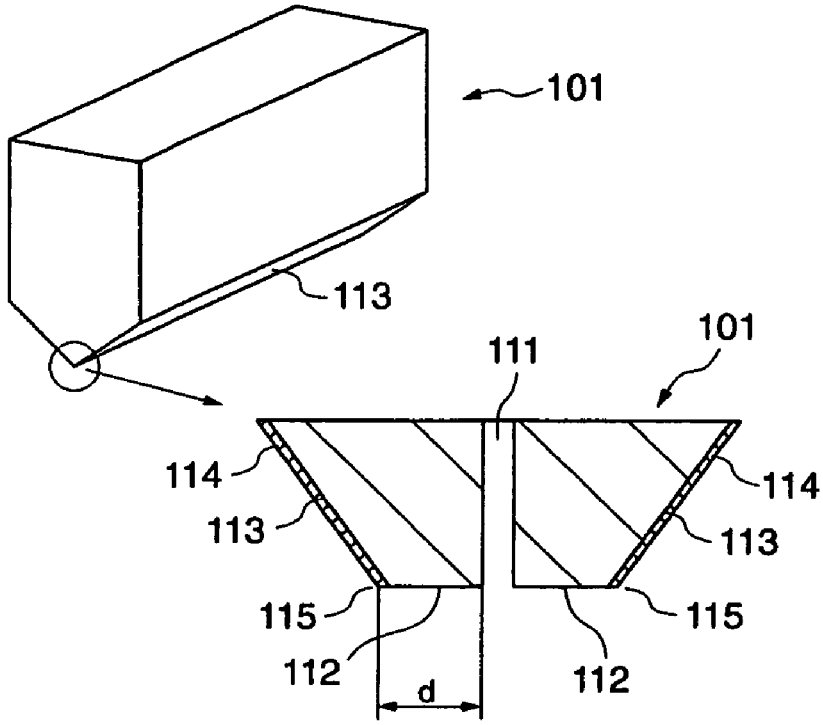
FIG. 10 is a perspective schematic view of another implementation of a coating die head according to the present invention together with an enlarged view of a portion of this perspective view.
Figure 11:
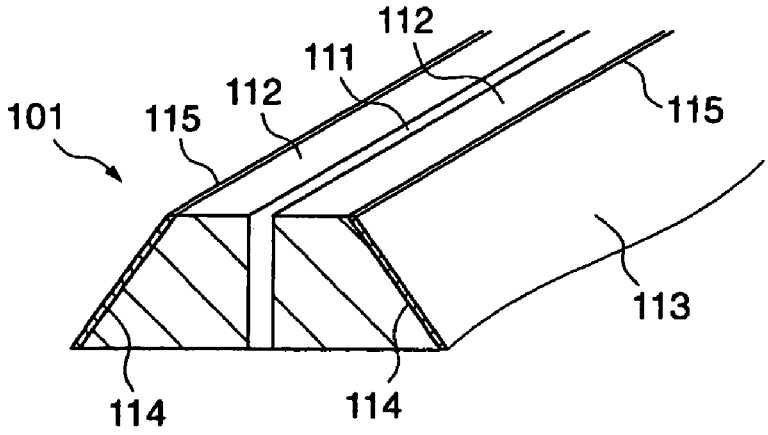
FIG. 11 is a perspective schematic view given by enlarging a terminal segment of the coating die head shown in FIG. 10.

FIG. 10 is a perspective schematic view of another implementation of a coating die head 101 according to the present invention together with an enlarged view of a portion of this perspective view. FIG. 11 is a perspective schematic view given by enlarging a terminal segment of this coating die head 101.

This coating die head 101 has a slot 111 for emitting a coating liquid to be applied, a lip 112 located on a terminal segment 112, 113 of the coating die head and having a lip surface 112 extending outwardly from the slot 111 in a direction generally normal to the slot 111, and a side 113 located on the terminal segment 112, 113 and having a side surface 113 extending outwardly from the lip surface of the lip 112 and inclined thereto. The whole body of the coating die head 101 is made of stainless steel.

In this embodiment, the lip surface of the lip and the side surface of the side can be represented by reference numerals 112 and 113 respectively.

The lip surface 112 extends in the normal direction over a width d, which width d normally ranges from 0.1 to 1.0 mm.

The lip surface 112 is a bare surface resulting from exposing the body of the coating die head 101 grounded to surface roughness 0.05 μm in Rmax by ELID (ELectrolytic In-process Dressing) grinding. The surface roughness is herein expressed in terms of the maximum height, Rmax, over the entire area of a surface scanned and measured in accordance with Japanese Industrial Standard JIS B 0601. The data on surface roughness were obtained by the contact stylus measurement method in accordance with JIS B 0601.

Rmax 0.05 or 0.05 μm in Rmax means that the maximum height is 0.05 μm. JIS B 0601 corresponds to ISO 0486 (1982), ISO 3276(1975), ISO 4287-1(1984), ISO 4287-2 (1984) and ISO 4288(1985).

The side surface 113 consists of a surface layer 114 formed by coating or plating material having poor wettability with respect to the coating liquid. Accordingly, the surface layer 114, serving as the side surface 113, has poor wettability with respect to the coating liquid (a large contact angle with respect to the coating liquid). In this embodiment, the surface layer 114 is formed by electroless plating of a mixture containing nickel (Ni) and 1 to 10 wt % of fluororesin.

If the coating liquid is in the form of liquefied resist generally used for the fabrication of color filters for liquid crystal displays, a contact angle of the lip surface 112 with respect to the coating liquid falls in a range from 7 degrees to 10 degrees. If, under this condition, the surface layer 114 is formed by electroless plating of a mixture containing nickel (Ni) and 1 to 10 wt % of fluororesin, a contact angle of the side surface 113 with respect to the coating liquid amounts to 55 degrees, and thus the difference in angle amounts to 40 degrees at least. When the content of fluororesin is less than or equal to 10 wt %, the surface layer 114 is as hard as the bare body (Rockwell Hardness: HRC 45 to 55) and so has durability as much as the lip surface 112. When the content of fluororesin is less than 1 wt %, the surface layer 114 lose superiority to the lip surface of the lip 112 in contact angle with respect to the coating liquid. When the content of fluororesin is greater than 10 wt %, the surface layer 114 cannot maintain durability as much as the lip surface 112. It is necessary to form the surface layer 114 so that the surface layer 114 can extend to cover at least a region, which might be covered by the spread of coating liquid during coating process.

As shown in FIG. 11, the surface layer 114 extends over the whole surface area 113 and has an edge lying on a border line 115 between the lip surface 112 and the surface layer 114. The border line 115 provided between the lip surface 112 and the surface layer 114 on the side surface 113 is straight, and it has straightness and parallelness, with respect to the slot 111, which are less than or equal to 2 μm/m.

Figure 12:
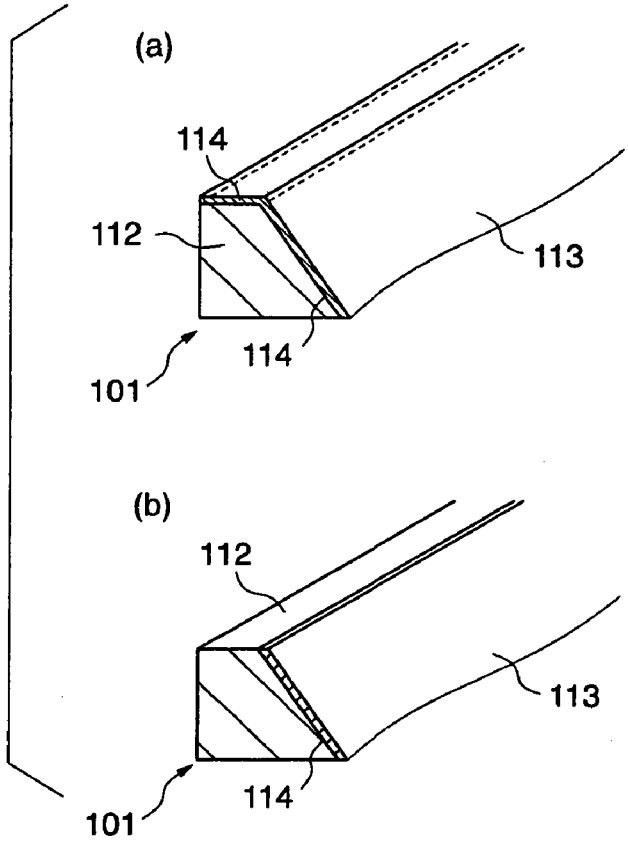
FIGS. 12(*a*) and 12(*b*) are perspective schematic views illustrating processes of fabricating the coating die head shown in FIG. 10.

In order to form the surface layer 114 to the edge exactly defining the border line 115 having the straightness and parallelness less than or equal to 2 μm/m, material of the surface layer 114 is deposited, by plating or coating, over the entire surface area of not only the side surface 113, but also the lip surface 112 as shown in FIG. 12(*a*), and then a portion of the material is removed, by polishing, for example, to expose the lip surface 112 and the edge of the surface layer 114 as shown in FIG. 12(*b*). The data on straightness of the border line 115 were obtained by the contact stylus measurement method in accordance with JIS B 0601.

Figure 13:
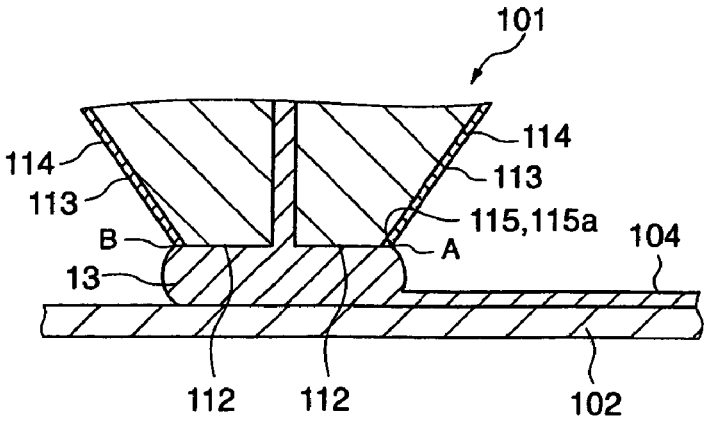
FIG. 13 is a cross sectional schematic view of the coating die head shown in FIG. 10 during application of coating liquid to the surface of a substrate.

For application of the coating liquid using the coating die head 101, the terminal segment 112, 113 of the coating die head 101 is held in close proximity to the surface of a substrate 102 placed on a chuck (not illustrated) as shown in FIG. 13, and the substrate 102 is moved relative to the coating die head 101. The coating die head 101 emits the coating liquid to be applied to the substrate 102, forming bead 103 between the lip surface 112 and the substrate 102, applying a portion separated from the bead 103 to the substrate 102.

Figure 14:
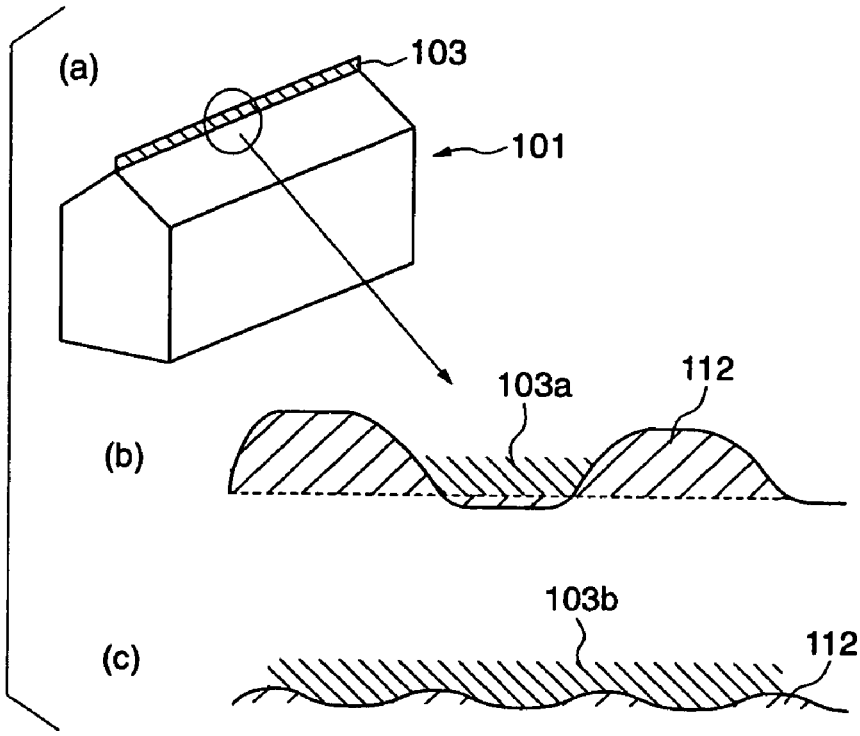
FIGS. 14(*a*), 14(*b*) and 14(*c*) are a perspective schematic view of a coating die head emitting coating liquid, an enlarged view of a lip that has been surface finished using free slurry, and an enlarged of a lip that has been surface finished using ELID (ELectrolytic In-process Dressing) grinding process, respectively.
Figure 15:
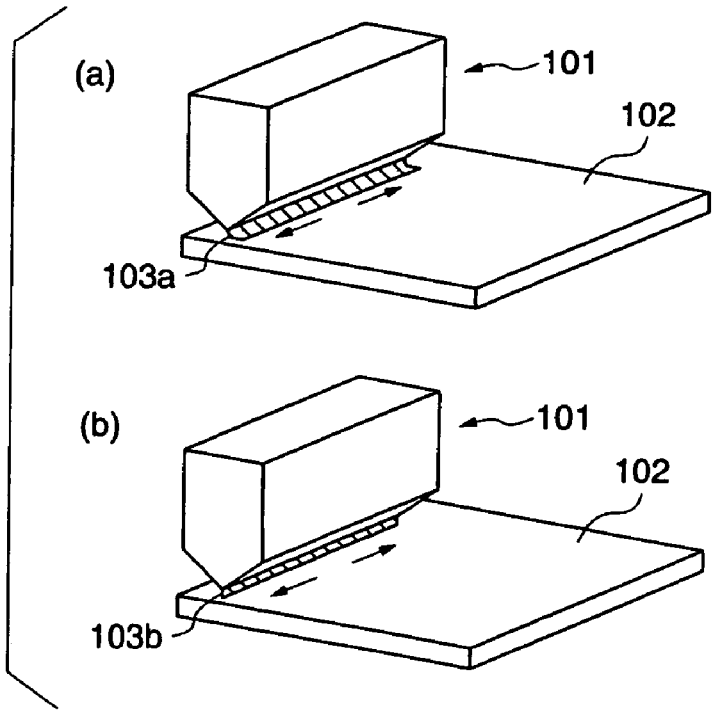
FIGS. 15(*a*) and 15(*b*) are a perspective schematic view of initial bead formed during application of coating liquid using a coating die head incorporating the lip that has been surface finished using free slurry, and a perspective schematic view of initial bead formed during application of coating liquid using a coating die head incorporating the lip that has been surface finished using ELID grinding process, respectively.

FIG. 14(*a*) is a perspective view of the coating die head 101 emitting coating liquid. As shown in FIG. 14(*b*), if a lip surface 112 of a coating die head 101 is grounded using free slurry in the conventional manner, the lip surface of the lip 112 is rough and involves considerably great local changes in contact angle with respect to the coating liquid, failing to allow smooth movement of the coating liquid in a bead growing direction laterally with respect to a direction of displacement of a substrate relative to the coating die head, thus increasing time required for build-up of bead 103*a*. Accordingly, as shown in FIG. 15(*a*), the quantity of coating liquid consumed for initial build-up of bead 103*a* (this quantity being often called initial bead quantity) increases. Thus, thickness of the layer formed on the substrate 102 is increased remarkably within an area applied with the coating liquid immediately after the start of application of the coating liquid, providing an elongated fault range where the desired thickness uniformity fails to be accomplished.

As shown in FIG. 14(*c*), if a lip 112 of a coating die head 101 is processed with ELID grinding process, the lip surface 112 has smooth surface roughness. This surface roughness is smooth enough to sufficiently suppress local changes in contact angle with respect to the coating liquid, allowing smooth movement of coating liquid in a bead growing direction laterally with respect to a direction of displacement of a substrate relative to the coating die head, thus shortening time required for build-up of bead 103*b*. Accordingly, as shown in FIG. 5(*b*), the initial bead quantity for bead 103*b* is reduced satisfactorily, thus shortening a fault range in a coating layer 104, where the desired thickness uniformity fails to be accomplished, to a very small length (for example, less than or equal to 5 mm). If it is used during a resist coating process of fabrication of color filters for liquid crystal displays, the coating die head 101 can carry out high precision coating (for example, the fault range less than or equal to 5 mm) required for the fabrication.

The lip surface 112 processed with ELID grinding process to mirror finish has surface roughness less than or equal to 0.3 μm in Rmax, which is smooth enough to sufficiently suppress local changes in contact angle. Therefore smooth movement of the coating liquid can be made in a bead growing direction laterally with respect to a direction of displacement of the substrate relative to the coating die head, thus shortening time required for build-up of bead 103. For further facilitating smooth movement of the coating liquid to shorten the time required for the bead build-up, it is preferred that the surface roughness is less than or equal to 0.1 μm in Rmax. More preferably, the surface roughness is less than or equal to 0.05 μm in Rmax.

As described before, the contact angle of the side surface 113 of the coating die head 101 is greater than that of the lip surface 112. The side surface 113 has poor wettability with respect to the coating liquid. This configuration can maintain a point A or B, at which the uppermost portion of the bead 103 of liquid falls off the coating die head 101, always at an area where the lip surface 112 with good wettability and the side surface 113 with poor wettability define therebetween the border line.

During application of the coating liquid to the substrate 102, the bead 103 is kept stabilized, applying the coating liquid to the substrate 102 without any stripes and steps conventionally experienced. Thus, it is possible to form a coating layer 104 that has accomplished thickness uniformity by suppressing thickness variation to a sufficiently low level (for example, thickness variation within ±1.5% of the layer thickness). Accordingly, if it is used during a resist coating process of fabrication of color filters for liquid crystal displays, this coating die head 101 can carry out high precision coating (for example, thickness variation within ±1.5% of the layer thickness) required for the fabrication.

Figure 16:
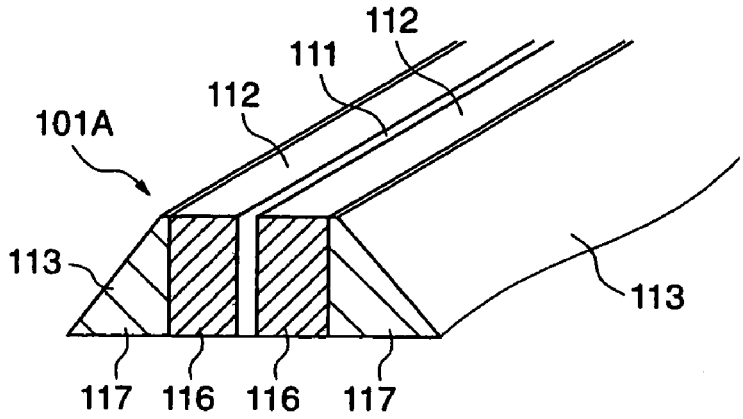
FIG. 16 is a perspective schematic view of a terminal segment of another implementation of a coating die head according to the present invention.
Figure 17:
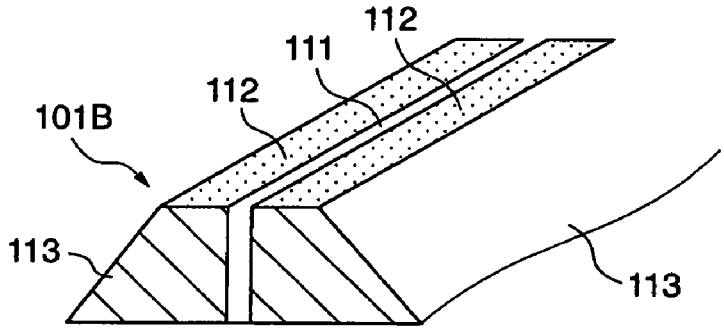
FIG. 17 is a perspective schematic view of a terminal segment of another implementation of a coating die head according to the present invention.

In the above-described implementation, the lip surface 112 is formed of the bare surface of the body and the surface layer 114 of the side surface 113 has poor wettability (large contact angle), thus providing the side surface 113 with a contact angle greater than that of the lip surface. The present invention is not limited to this configuration, which is just one example of altering contact angles of the lip surface of the lip 112 and side surface of the side 113. Referring, for example, to FIG. 16, a coating die head 101A includes separate members of different materials as portions 116 and 117, respectively, which form the lip surface 112 and side surface 113. Referring to FIG. 17, although a coating die head 101B is made of the same material, the coating die head 101B is formed by surface treatment to give a lip surface 112 more roughness to provide good wettability (by reducing contact angle) and by another surface treatment to give a side surface 113 less roughness to provide poor wettability (by increasing contact angle). Using these measures, the contact angle of the side surface 113 can be made greater than that of the lip surface 112. The contact angles of the lip surface and the side surface may be altered by appropriately combining a selection in material with a selection in surface treatment to provide roughness.

It is likely that, around the border line 115 between the side surface 113 and the lip surface 112, a contact angle border line 115*a* exits, which is provided or defined between the adjacent two regions that differ from each other in contact angle with respect to the coating liquid to such an extent as to demonstrate different identities in contact angle. If this is the case, it is preferred that a deviation between the contact angle border line 115*a* and the border line 115 is less than or equal to 2 μm (see FIG. 13).

Figure 18:
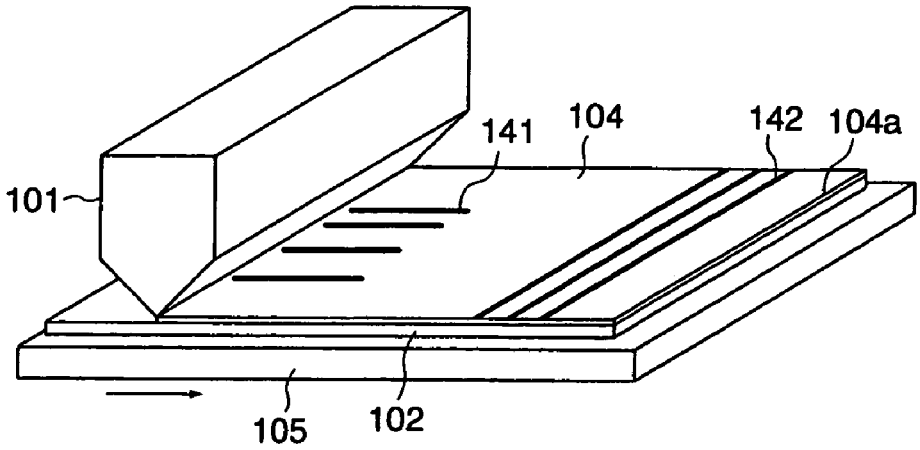
FIG. 18 is a perspective schematic view of another comparative example of a coating die head during application of coating liquid to the surface of a substrate.
Figure 19:
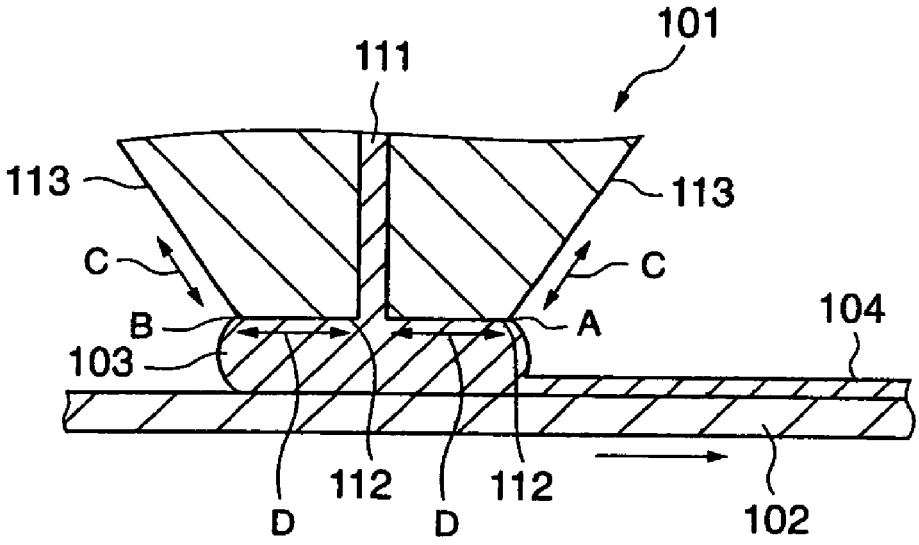
FIG. 19 is a cross sectional schematic view of another comparative example of a coating die head during application of coating liquid to the surface of a substrate.
Figure 20:
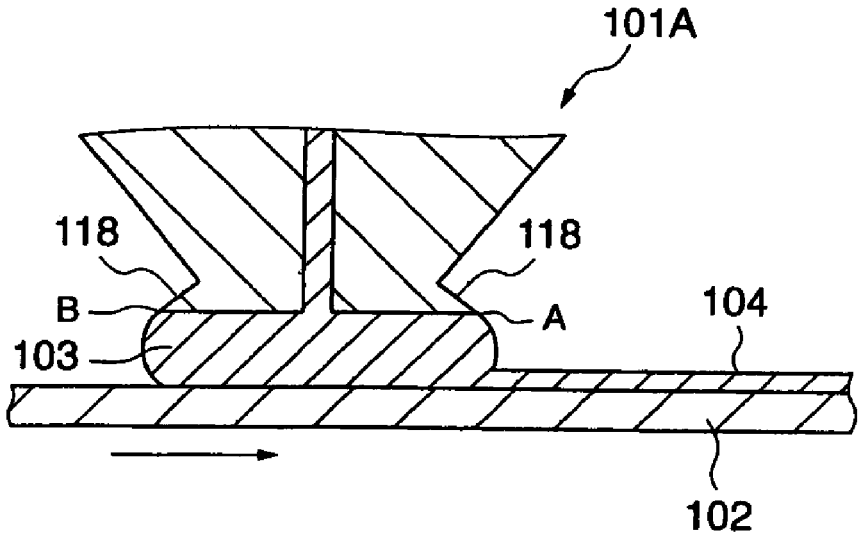
FIG. 20 is a cross sectional schematic view of another comparative example of a coating die head during application of coating liquid to the surface of a substrate.

With reference next to FIGS. 18 to 20, comparative examples to the present invention are described.

As shown in FIG. 18, a coating die head 101, which includes a generally-configured lip surface and a generally-configured side surface, is arranged with its terminal segment in close proximity to the surface of a substrate 102 placed on a chuck 105. Next, the chuck 105 moves the substrate 102 for displacement relative to the coating die head 101 emitting liquefied resist, and applying the emitted liquefied resist to form a coating layer 104. Subsequently, thickness uniformity of the layer 104 is accomplished by rotating the substrate 102. By employing spin coating immediately after applying the resist to the substrate by the coating die head, a cost is increased because of two processes needed. Japanese Patent No. 3201195 discloses a coating process in which thickness uniformity is accomplished by applying coating liquid to a substrate using a coating die head only. However, this known coating process is not satisfactory because it cannot meet the specification demanded by current fabrication of color filters for liquid crystal displays. The specification states that a fault range where the thickness uniformity fails to be accomplished, should be less than or equal to 5 mm in an applying direction as measured from a start point 104*a*.

However, it is difficult to suppress the fault range within 5 mm in the applying direction from the start point 104*a* when using the coating die head 101.

Next, it will be explained what causes a fault range where thickness uniformity fails to be accomplished, within the adjacent area to the start point 104*a* when coating liquid is applied to the substrate by the coating die head 101. As shown in FIG. 19, the coating die head 101 has a slot 111 for emitting resist (coating liquid) to be applied, a lip 112 having a lip surface extending outwardly from the slot 111 in a direction generally normal to the slot 111, and a side 113 having a side surface extending outwardly from the lip surface of the lip 112 and inclined thereto. During application of coating liquid to the surface of the substrate 102, the coating die head 101 forms coating liquid lump (bead) 103 between the lip surface 112 and the substrate 102. In general, the quicker bead builds up, the shorter is the fault range where the thickness uniformity fails to be accomplished. However, in fact, this fault range cannot be shortened because local changes in contact angle existing in the lip surface 112 fail to allow smooth movement of coating liquid in a bead growing directions laterally with respect to a direction of displacement of the substrate. The local changes in contact angle remain in the lip surface 112 because polishing-dependent surface finish varies with different performance levels of polishing machines and different skill levels of labor. As the coating liquid is not allowed to flow smoothly and quickly, it takes a long time for build-up of bead 103. Substantial quantity of coating liquid is consumed for build-up of bead 103 (initial bead quantity). Thus, thickness is increased within the adjacent area to the start point, resulting in an increase in length of the fault range where the thickness uniformity fails to be accomplished.

Further, the thickness variation can not be suppressed by the coating die within an acceptable range, because stripes 141 and/or steps 142 appear in the coating layer 104 as described below. Now, it will be explained what causes thickness variation in the coating layer when coating liquid is applied to the substrate by the coating die head 101. With reference to FIG. 19, if the bead 103 were stabilized to maintain its shape thereby to maintain a point A or B, at which the uppermost portion of the bead 103 of liquid falls off the coating die head 101, always at an area where the lip surface 112 and a side surface 113 define therebetween a border line, the coating layer 104 would be free from the undesired thickness variation. However, in the comparative example, the point A or B can not be maintained at the area where the border line exists, but instead the liquid flows around from the lip surface 112 to the side surface 113, as a result the liquid moves along the side surface 113 as shown by arrow C as well as/along the lip surface 112 as shown by arrows D. Such motions of the liquid hamper stabilization of the bead 103, thus failing to prevent the point A or B from moving to various locations from the border line. If the point A or B moves to various locations at each of a plurality of spaced points along the border line, stripes 141 (see FIG. 18) extending in a direction of movement of the substrate will appear, whereas if the point A or B moves to various locations continuously along the border line, steps 142 lying laterally with respect to the moving direction of the substrate will appear.

In order to restrain the point A or B from moving to various locations for enhanced stabilization of bead 103, one may devise a coating die head 101A, as shown in FIG. 20, which has an acute edge 118 on or in parallel to a border line between a lip surface 112 and the adjacent side. This coating die head 101A, however, fails to sufficiently restrain the point A or B from moving to various locations, although it provides enhanced stabilization of the bead 103 more than the coating die head 101 shown in FIG. 19. Stripes and steps can be reduced, but it is not sufficient enough to provide high precision coating required during fabrication of color filters for crystal displays.

According to the present invention, as the local changes in contact angle have been suppressed satisfactorily due to a reduction in surface roughness, the coating liquid is allowed to move smoothly and quickly, shortening time required for bead build-up. Accordingly, if it is used during a resist coating process of fabrication of color filters for liquid crystal displays, the coating die head incorporating this configuration can carry out high precision coating required for the fabrication by shortening as best as possible a fault range where thickness uniformity fails to be accomplished.

According to the present invention, a point at which the uppermost portion of bead of coating liquid falls off a coating die head can be maintained always at an area where the lip surface and the side surface define therebetween a border line. Accordingly, if the coating die head is used during a resist coating process of fabrication of color filters for liquid crystal displays, the coating die head incorporating the above configuration can carry out high precision coating required for the fabrication by suppressing as much as possible thickness variation in the coating layer.

If the coating die head is used during a resist coating process of fabrication of color filters for liquid crystal displays, the coating die head according to the present invention can carry out high precision coating required for the fabrication by shortening as much as possible a range where thickness uniformity is not yet accomplished, as well as by suppressing as much as possible thickness variation in the coating layer.

The invention claimed is:

1. A coating die head with a slot for emitting coating liquid to be applied to a substrate, comprising:

a lip located on a terminal segment of the coating die head and having a lip surface extending from the slot; and a side located on the terminal segment and having a side surface inclined to the lip surface;

wherein the side surface and the lip surface are configured such that a contact angle of the side surface with respect to the coating liquid is greater than a contact angle of the lip surface with respect to the coating liquid;

wherein a border line is provided between the lip surface and the side surface and the border line has straightness and parallelness, with respect to the slot, which are less than or equal to 5 μm/m;

wherein, around the border line, a contact angle border line is provided between the adjacent surface regions that differ from each other in contact angle with respect to the coating liquid; and wherein a deviation between the contact angle border line and the border line is less than or equal to 5 μm.

2. The coating die head as claimed in claim 1, wherein the side surface and the lip surface are configured such that the contact angle of the side surface with respect to the coating liquid is greater than the contact angle of the lip surface with respect to the coating liquid by a difference, in angle, that is greater than or equal to 5 degrees.

3. The coating die head as claimed in claim 1, wherein surface material of the side surface is different from that of the lip surface.

4. The coating die head as claimed in claim 1, wherein surface roughness of the side surface is different from that of the lip surface.

5. A coating apparatus comprising:

a coating die head with a slot for emitting coating liquid to be applied to a substrate, the coating die head including a lip located on a terminal segment of the coating die head and having a lip surface extending from the slot; and a side located on the terminal segment and having a side surface inclined to the lip surface, wherein the side surface and the lip surface are configured such that a contact angle between the side surface and the coating liquid is greater than a contact angle between the lip surface and the coating liquid; and means for carrying out relative displacement between the substrate and the coating die head with the terminal segment held in close proximity to the substrate for application of the emitted coating liquid to the substrate;

wherein a border line is provided between the lip surface and the side surface and the border line has straightness and parallelness, with respect to the slot, which are less than or equal to 5 μm/m;

wherein, around the border line, a contact angle border line is provided between the adjacent surface regions that differ from each other in contact angle with respect to the coating liquid; and wherein a deviation between the contact angle border line and the border line is less than or equal to 5 μm.

6. A coating die head with a slot for emitting coating liquid to be applied to a substrate, comprising:

a lip located on a terminal segment of the coating die head and having a lip surface extending from the slot; and a side located on the terminal segment and having a side surface inclined thereto;

wherein surface roughness of the lip surface expressed in terms of the maximum height, Rmax, measured in accordance with Japanese Industrial Standard JIS B 0601 is less than or equal to 0.3 μm;

wherein the side surface and the lip surface are configured such that a contact angle of the side surface with respect to the coating liquid is greater than a contact angle of the lip surface with respect to the coating liquid;

wherein, around a border line between the lip surface and the side surface, a contact angle border line is provided between the adjacent regions that differ from each other in contact angle with respect to the coating liquid; and wherein a deviation between the contact angle border line and the border line is less than or equal to 2 μm.

7. The coating die head as claimed in claim 6, wherein the lip surface is of mirror finish resulting from super fine grinding.

8. The coating die head as claimed in claim 6, wherein the lip surface is of mirror finish resulting from electrolytic in-process dressing (ELID) grinding.

9. The coating die head as claimed in claim 6, wherein the side surface is made of electroless plating of a mixture containing nickel (Ni) and 1 to 10 wt % of fluororesin.

10. The coating die head as claimed in claim 6 wherein surface roughness of the side surface is different from that of the lip surface.

11. The coating die head as claimed in claim 6, wherein a border line is provided between the lip surface and the side surface, and the border line has straightness and parallelness, with respect to the slot, which are less than or equal to 2 μm/m.

* * * * *